United States Patent [19]

Roberts

[11] Patent Number: 4,971,149

[45] Date of Patent: Nov. 20, 1990

[54] FLUSH MOUNT MONITORING WELL COVER

[75] Inventor: Daniel R. Roberts, Springfield, Mo.

[73] Assignee: Charles Wayne Roberts, Columbia, Ill.

[21] Appl. No.: 413,597

[22] Filed: Sep. 28, 1989

[51] Int. Cl.[5] ..... E21B 33/02

[52] U.S. Cl. ..... 166/92; 166/75.1; 137/371; 404/25

[58] Field of Search ..... 404/25, 26; 137/371; 220/18, 210, 293, 315, 323; 166/92, 75.1

[56] References Cited

U.S. PATENT DOCUMENTS

| | | | |
|---|---|---|---|
| 911,256 | 2/1909 | McWane | 404/25 |
| 1,791,277 | 2/1931 | Lake | 220/210 |
| 3,173,572 | 3/1965 | Beecher | 220/323 |
| 4,370,919 | 2/1983 | Wagner et al. | 220/210 |
| 4,614,281 | 9/1986 | Wright | 220/323 |
| 4,669,536 | 6/1987 | Ames et al. | 166/68 |
| 4,747,453 | 5/1988 | Howard | 166/96 |

FOREIGN PATENT DOCUMENTS

| | | | |
|---|---|---|---|
| 2593473 | 1/1986 | France | 220/210 |

*Primary Examiner*—Ramon S. Britts
*Assistant Examiner*—Roger J. Schoeppel
*Attorney, Agent, or Firm*—Alan B. Samlan

[57] ABSTRACT

An apparatus for covering the top of a monitoring well with a lockable, weathertight cover which can be easily removed to allow ready access to the monitoring well so that water samples can be taken as desired. The device is positioned over the monitoring well casing in such a manner that when installation is complete, the monitoring well cover is mounted flush and level with the surrounding terrain.

4 Claims, 1 Drawing Sheet

FIG. 1
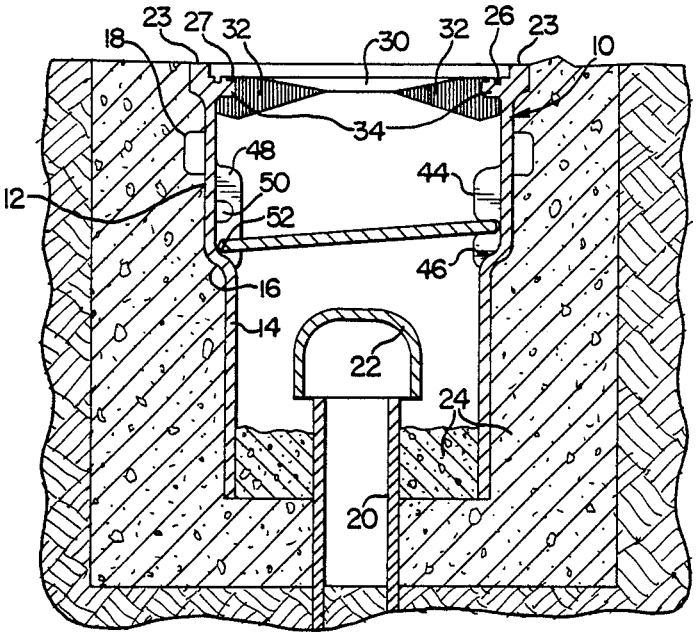
FIG. 2
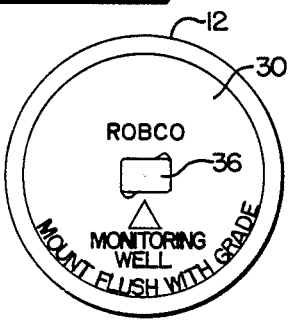
FIG. 3a
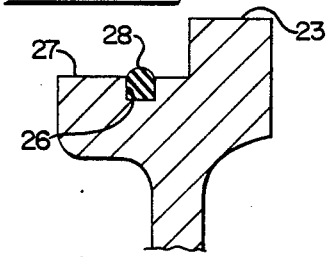
FIG. 6
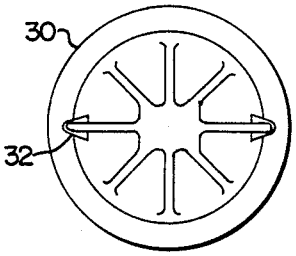
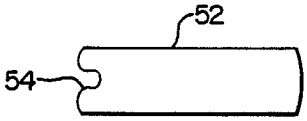
FIG. 5
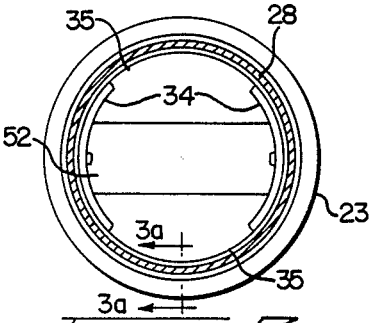
FIG. 3
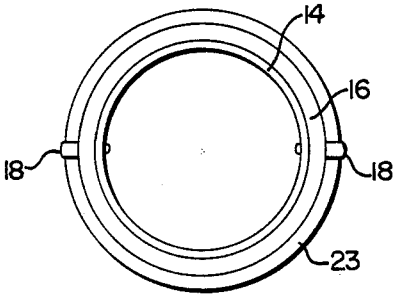
FIG. 4
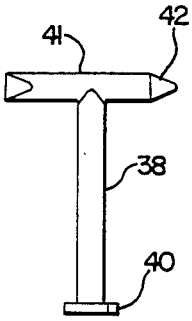
FIG. 7

FLUSH MOUNT MONITORING WELL COVER

BACKGROUND AND SUMMARY OF THE INVENTION

This invention relates primarily to ground water monitoring well systems and more particularly to providing a monitoring well cover that mechanically and environmentally protects the monitoring well.

Recent federal, state and local laws, regulations and ordinances require the drilling and placement of monitoring wells in the vicinity of storage tanks, open containment pooling areas of hazardous or waste materials or liquids, and various other categories of potentially hazardous or harmful activities which could leak or leach contaminants to the common underground water supply or water table. The design and construction of the monitoring wells and the related sampling equipment has given rise to a new technology which is substantially different from the equipment required for conventional water supply wells.

The concern for such laws and ordinances is to protect as much as possible the quality of the underground water table used as a drinking water supply or for other similar purposes. The theory of monitoring well use is that strategic placement of a specified number of wells around storage or manufacturing sites containing pollutants or toxic materials, and subsequent periodic sampling of water from the monitoring wells, would give an early indication of underground water supply contamination in the immediate vicinity of the potential threat. Samples taken from the monitoring wells on a periodic and systematic basis would be tested for their water quality. If a leak or leaching process begins to occur at the storage, manufacturing or processing site, the effects of pollutant intrusion into the underground water supply will be discovered early in its initial stages. The ability to discover early a serious water pollution problem in its formative stages will enable regulatory bodies or agencies to bring this to the immediate attention of those parties responsible for this problem. It also allows specific identification of a polluting site to the exclusion of others which may be in the area but not contributing to underground water pollution. The key to the success of such a system of proctoring lies in a program of systematic and continuous recovery of water samples from the monitoring wells and in maintaining the integrity of such monitoring wells from external events which could cause erroneous and biased readings from water quality analysis done on the recovered samples.

The monitoring well industry has developed monitoring wells which do not add to the potential pollution problem and which will give a representative sample of the ground water. Ground water samples can now be analyzed in the parts per billion range such that extremely accurate readings are readily available. One example is illustrated in U.S. Pat. No. 4,669,536 which illustrates an entire ground water monitoring system.

A problem with the system illustrated in the '536 patent, and one which is universal to all ground water monitoring systems, is that the top of the well is not protected from environmental or external mechanical forces which may damage the well or cause erroneous readings. As can be seen in the '536 patent as is common to all currently installed monitoring wells, the well extends above the ground a certain distance. The extension of the well above the surrounding ground level creates a potential problem whereby the well head can be struck by tractors, lawn mowers, vehicles or other external forces. Furthermore, it is exposed to the environment and can easily be tampered with.

The present invention relates to a well cover that seals and protects the monitoring well head and casing cover from foreign or extraneous liquid or solid contaminants or from contaminants resulting from natural rain fall, water runoff, or the shallow pooling of liquid occuring in the vicinity of the monitoring well casing cover.

According to one aspect of the present invention, the monitoring well casing has a liquid tight cover which is removable so that water samples can be taken. The well casing must be capable of being locked or placed within a housing which can be locked. Applicant has provided a well casing opening that is protected against outside contamination and which is mechanically sealed against the intrusion of natural elements such as rain fall or shallow pooling of spilled chemical liquids in the surrounding area. There is provided a main body housing which surrounds the well casing and well casing cover. The main body housing is anchored in place by concrete for stability. There is a main body housing cover which is received by the top of the main housing body and designed such that the cover will be flush with the surrounding ground level. A gasket between the cover and the main body housing provides a weather-tight seal. Furthermore, the cover is designed so that it will lock when rotated. Preferably, a special tool with a custom key will be received by a keyway in the cover so that opening the cover can only be done by authorized personnel.

Between the top of the main body housing and the well casing is a locking bar which restricts access to the well casing and well cover. The locking bar will be kept in place by means of a standard or conventional lock. With the lock opened, the locking bar can be removed permitting the person taking the sample to have access to the well cover.

Accordingly, it is an object of the present invention to provide a monitoring well cover which is flush with the surrounding ground level. An advantage of providing such a well cover is that the well will be protected from damage due to vehicles, tractors, lawn mowers or other such equipment.

Another object is to provide a weather-tight monitoring well that is sealed from the environment and will exclude the intrusion of natural elements such as rain fall or pooling of spooled chemicals in the vicinity of the ground water monitoring well.

Another object is to provide a ground water monitoring well cover that has locking means to limit the access to the ground water monitoring well by only authorized personnel.

Yet another object is to insure that monitoring wells are adequately and completely protected against false positive readings with regard to pollutant or toxic materials entering the well casing opening.

BRIEF DESCRIPTION OF THE DRAWINGS

FIG. 1 is a vertical cross-sectional view with portions removed illustrating the inventive flush mount monitoring well cover positioned over a monitoring well.

FIG. 2 is a top view of the flush mounted monitoring well cover in place as it is received by the main housing entire apparatus.

FIG. 3 is a top end view of the main housing body with the flush mounted cover removed and the locking means in place.

FIG. 3a is an enlarged cross-sectional view with portions removed taken along line 3a—3a of FIG. 3.

FIG. 4 is a bottom end view of the main body housing with the cover and locking bar removed.

FIG. 5 is a top view of the locking bar.

FIG. 6 is a bottom view of the flush mounted cover.

FIG. 7 is a side view of a tool for tightening or loosening the flush mounted cover.

DETAILED DESCRIPTION OF THE INVENTION

Turning first to FIG. 1 there is shown a cross-sectional view of the invention in its normal environmental setting. There is illustrated a main body housing 10 which is comprised of an upper body portion 12 connected to a lower body portion 14 by means of a tapered neck 16. A pair of ears 18 placed at opposite sides of the upper body portion 12 protrude radially outwardly from the outside of the upper body portion.

The invention is designed to protect a monitoring well which has a vertical well casing 20 normally made from PVC. The well casing 20 extends from ground level to the bottom of the monitoring well. There is a well cover 22 placed over the top of the well casing 20. Generally the well cover 22 is provided with sealing means which precludes the introduction of foreign matter down into the well casing 20. This is to insure the integrity of the samples drawn from the well.

The main body housing 10 is installed by first forming a recessed area around the well casing 20 sufficient to accommodate the main body housing 10. The recess area is made sufficiently deep to allow a lip 23 on the top surface of the main body housing 10 to lie in the same horizontal plane as the topography immediately surrounding the well area. Installation in this manner will allow foot or vehicular traffic to occur within the area without impedence or interference. Concrete or other sealing material 24 is poured within the cavity created between the outer wall of the well casing 20 and the interior of the lower body portion 14. Sufficient concrete is poured to seal the well casing below the well cover 22. The concrete 24 is also placed circumferentially around the main body housing 10 in sufficient quantity and volume to cause the main body housing 10 to be sealed. Furthermore, the concrete 24 will create a mechanical restraint and anchoring system which will hold the main housing body in place and resistant to external forces which might otherwise dislodge or move the main body housing 10. The ears 18 further assist the main body housing from movement as they are anchored in the concrete 24.

As seen in FIGS. 1 and 3, there is a channel 26 circumferentially disposed around a shoulder 27 formed just below and inside of the lip 23 on the top of the upper body portion 12. The channel 26 receives a sealing gasket 28 made of rubber or other suitable sealing material that will withstand the temperature variations and elements to which it will be exposed.

A flush mount cover plate 30 (as seen in FIG. 2) is adapted to be placed onto the shoulder 27 with the gasket 28 sealing the cover plate 30 to the upper body portion 12. The cover 30 has a pair of projecting locking flanges 32 extending radially from the underside of the cover 30 and near its outer circumferential edges (see FIG. 6). The shoulder 27 forms a pair of inner projecting ledges 34 at opposite sides of the upper body portion 12. These can best be illustrated in FIG. 3 wherein the top of the inner projecting ledges 34 are seen. It can also be seen that there is a pair of opposed gaps 35 between the ends of the inner projecting ledges 34 which are designed to permit the projecting locking flanges 32 to extend down into the upper body portion 12 to a position beneath the projecting ledges 34. After the cover 30 is set on the shoulder 27 with the flanges 32 aligned with the gaps 35, it is rotated approximately 90°. The two projecting flanges 32 will slide beneath the two corresponding inner projecting ledges 34 of the main body housing 10. This causes the cover 30 to be sealed by the gasket 28 and tightly locked in place to the upper body portion 12.

As seen in FIG. 2, the flush mounted cover 30 has a square keyway 36 located in its center. A tool 38, as seen in FIG. 7, has at one end a square base 40 and at the opposite end a T-handle 41. One end of the T-handle has a chisel end 42. The square base 40 is dimensioned to be slightly smaller than the dimensions of the square keyway 36. When the base 40 is inserted into the keyway 36, the T-handle 41 is grasped and can be used to assist in easily rotating the flush mounted cover 30. In the event that the temperatures are below freezing and ice or snow has accumulated on the flush mounted cover 30, the T-handle 41 with its chisel end 42 can be used to break and chip the ice from the top surface of the flush mounted cover 30. The end of the T-handle 41 opposite the chisel handle 42 can be provided with a hammer-like weight to aid in chipping away ice.

In order to insure that only authorized personnel can draw samples and have access to the well casing 20, it is necessary to provide a locking mechanism which can only be opened by authorized personnel. Such a locking mechanism is illustrated in FIGS. 1, 3, and 5. The upper body portion 12 has an internal vertical tab 44 radially disposed in one location. There is a recess 46 placed slightly higher than the tapered neck 16. Diametrically opposed from the vertical tab 44 is a second vertical tab 48 also disposed along the inner surface of the upper body portion 12. This second vertical tab 48 does not have a recess 46 but instead has a lock loop 50. A lock bar 52 (as seen in FIG. 5) made of metal has a notch 54 formed in one end. The end of the lock bar 52 opposite the notched end is first inserted into the recess 46 on the vertical tab 44. The lock bar 52 is then pushed down over the second vertical tab 48 with the notch 54 straddling the second vertical tab 48. The notched end of the lock bar comes to rest against the tapered neck 16. The shackle of a suitable lock is placed through the lock loop 50 and the lock is pushed into the locked position. Thus, the lock bar 52 cannot be removed and there is no access to the well cover 22. Only when an authorized person removes the lock and lock bar 52 is access again available to the well cover 22 in order to take a sample.

Water samples can readily be taken from the monitoring well simply by removing the weather-tight flush mount cover plate 30, unlocking the lock, removing the lock bar 52 and finally removing the monitoring well cover 22. After samples have been taken, the monitoring well is then re-closed and safely secured by reversing this procedure.

Water intrusion from inclement weather cannot occur with the flush mount well cover since there is a weather-tight seal between the flush mount cover plate 30 and the main body housing 10. Similarly, shallow pooled liquid contaminants flowing in the area will be unable to penetrate the main body housing 10 and the integrity of samples taken from the monitoring well will not be compromised or contaminated.

Accordingly, there has been provided a flush mounted monitoring well cover that mechanically and environmentally protects the monitoring well. While the invention has been described in conjunction with specific embodiments thereof, it is evident that many alternatives, modifications, and variations will be apparent to those skilled in the art in light of the foregoing description. Accordingly, it is intended to embrace all such alternatives modifications, and variations as fall within the spirit and broad scope of the appended claims.

What is claimed is:

1. A flush mounted well cover for protecting a ground water monitoring well, the monitoring well having a well casing extending down from the well cover, the well cover comprising:

an integrally formed unitary piece main body housing having an upper body portion terminating at a top open end and a lower body portion terminating at a bottom open end opposite each other, a tapered neck connecting the upper body portion and the lower body portion, the bottom open end placed over the top of the well casing and the top open end substantially flush with the ground level surrounding the monitoring well, a locking bar disposed between the top open end and the top of the well casing, the locking bar extending diametrically across the tapered neck connecting the upper and lower body portions whereby access to the well casing from the top open end is prohibited, a cover plate adapted to be received by the top open end in locking engagement, the cover plate being substantially flush with the ground level surrounding the monitoring well, the cover plate having a pair of protruding locking flanges on the underside of the cover plate and wherein the main body housing has a pair of complementary protruding ledges, the locking flanges adapted to be slid under the protruding ledges when the cover plate is mounted to the top open end and rotated, whereby the cover plate is secured to the main body and covers the top open end, a stepped shoulder around the internal perimeter of the top open end adapted to receive the cover plate, the stepped shoulder having a circumferential groove therein, and gasket means in the circumferential groove disposed between the main body housing and the cover plate for forming a water-tight seal between the main body housing and cover plate.

2. The well cover of claim 1 and further comprising vertical locking members affixed to the inside walls of the well cover, at least one locking member supporting the locking bar in place in at least one point and a lock receiving hole in the other locking member to receive a lock which locks the unlocking bar and prohibits its removal until the lock is removed.

3. The well cover of claim 1 wherein the top side of the well cover has a keyway means adapted to receive a tool which when inserted into the keyway means permits the cover plate to be rotated by turning the tool thereby placing the locking flanges in or out of alignment with the complimentary protruding ledges.

4. The well cover of claim 3 and further comprising a pair of ears protruding from the outside of the main body housing to anchor and restrain rotation of the main body housing due to rotational forces exerted on it when the cover plate is mounted or removed.

* * * * *